US011877655B1

(12) United States Patent
Stewart et al.

(10) Patent No.: US 11,877,655 B1
(45) Date of Patent: Jan. 23, 2024

(54) TREADMILL REPOSITIONING AND STORAGE SYSTEM

(71) Applicants: David Waldon Stewart, Tyler, TX (US); Richard W. Trevino, Bullard, TX (US)

(72) Inventors: David Waldon Stewart, Tyler, TX (US); Richard W. Trevino, Bullard, TX (US)

( * ) Notice: Subject to any disclaimer, the term of this patent is extended or adjusted under 35 U.S.C. 154(b) by 0 days.

(21) Appl. No.: 18/105,505

(22) Filed: Feb. 3, 2023

Related U.S. Application Data

(60) Provisional application No. 63/306,976, filed on Feb. 4, 2022.

(51) Int. Cl.
*A47B 83/00* (2006.01)
*A63B 22/02* (2006.01)
*A63B 22/00* (2006.01)

(52) U.S. Cl.
CPC ..... *A47B 83/001* (2013.01); *A63B 22/0046* (2013.01); *A63B 22/02* (2013.01); *A47B 2220/06* (2013.01); *A63B 2210/50* (2013.01)

(58) Field of Classification Search
CPC ..... A47B 83/001; A47B 2220/06; A63B 22/0046; A63B 22/02; A63B 2210/50
See application file for complete search history.

(56) References Cited

U.S. PATENT DOCUMENTS

| | | | | |
|---|---|---|---|---|
| 5,813,947 | A | 9/1998 | Densmore | |
| 6,224,516 | B1 | 5/2001 | Disch | |
| 7,780,578 | B2 | 8/2010 | Packham | |
| 7,892,148 | B1 * | 2/2011 | Stauffer | A63B 22/0235 482/8 |
| 8,485,945 | B2 | 7/2013 | Leonhard | |
| 9,782,625 | B1 * | 10/2017 | Blum | G06F 1/1632 |
| 9,795,827 | B2 * | 10/2017 | Wiener | A63B 22/02 |
| 9,955,789 | B2 | 5/2018 | Herring et al. | |
| 11,058,913 | B2 * | 7/2021 | Dalebout | A63B 22/001 |
| 11,285,361 | B1 | 5/2022 | Kostadis | |
| 2006/0247109 | A1 | 1/2006 | Powell | |
| 2014/0360413 | A1 | 12/2014 | Schenk et al. | |
| 2015/0251048 | A1 * | 9/2015 | Dalebout | A63B 71/0686 482/54 |
| 2016/0074701 | A1 * | 3/2016 | Wiener | A63B 22/02 482/54 |
| 2021/0046354 | A1 | 2/2021 | Oaks | |
| 2021/0299512 | A1 | 9/2021 | Kastadis | |

* cited by examiner

*Primary Examiner* — Andrew S Lo
*Assistant Examiner* — Andrew M Kobylarz
(74) *Attorney, Agent, or Firm* — R. Keith Harrison

(57) ABSTRACT

A treadmill repositioning and storage system may include a workstation. The workstation may have a workstation desk. A treadmill may be selectively extendable from and retractable into the workstation. In the extended position of the treadmill, a user may walk on the treadmill as the user accesses the workstation desk of the workstation to work or perform various other tasks. The system may thus enable the user to acquire the benefits of exercise while performing work at the workstation desk. The treadmill may be selectively retracted into the workstation when not in use, typically for space-saving purposes.

19 Claims, 15 Drawing Sheets

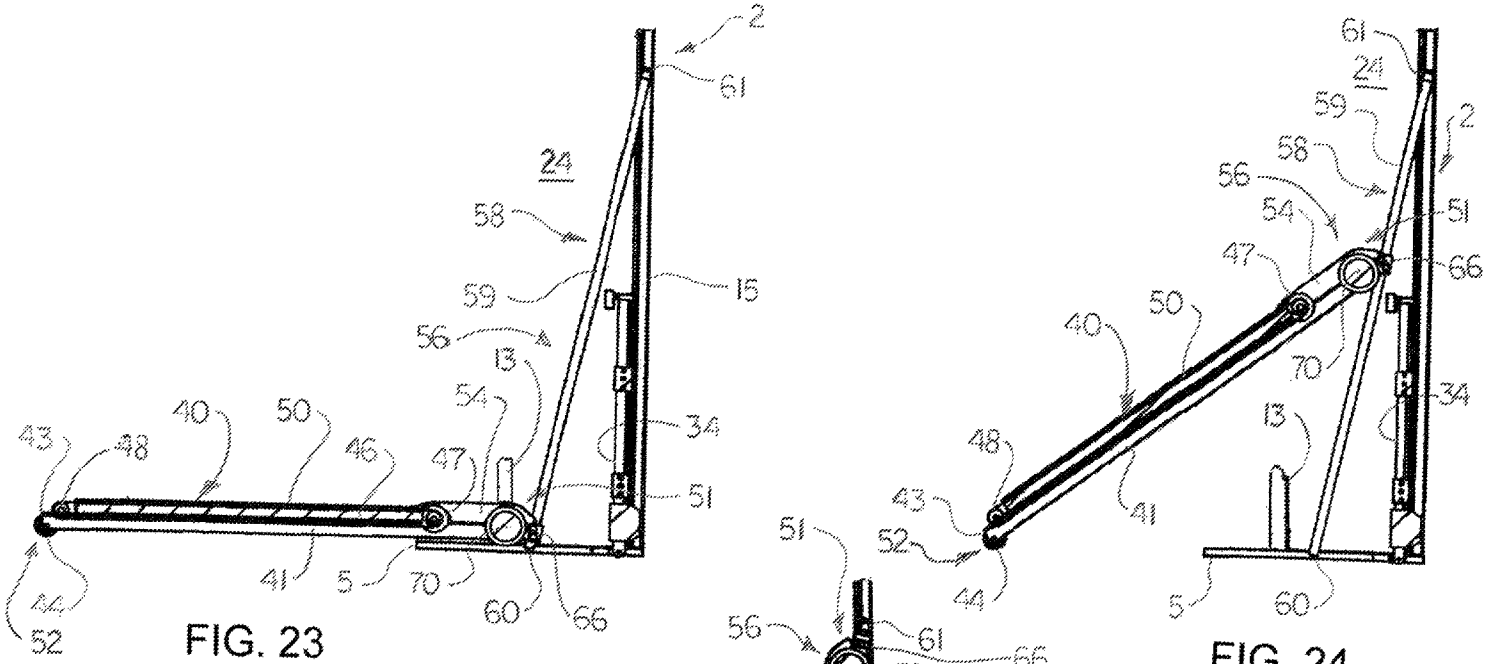
FIG. 24
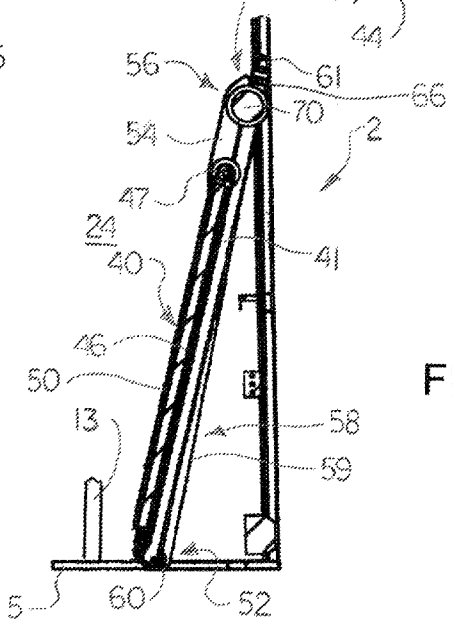
FIG. 25
FIG. 23

TREADMILL REPOSITIONING AND STORAGE SYSTEM

CROSS-REFERENCE TO RELATED APPLICATIONS

This application claims the benefit of U.S. provisional application No. 63/306,976, filed Feb. 4, 2022, and entitled SYSTEM FOR TREADMILL REPOSITIONING AND STORAGE, which provisional application is hereby incorporated by reference herein in its entirety.

FIELD

Illustrative embodiments of the disclosure generally relate to treadmills and office workstations, and more particularly, to a treadmill repositioning and storage system having a workstation which includes a treadmill that can be electronically and mechanically deployed in an extended, functional position for use in exercising while working and a concealed in a retracted, stowage position inside the workstation.

SUMMARY

Illustrative embodiments of the disclosure are generally directed to a treadmill repositioning and storage system having a workstation which includes a treadmill that can be electronically and mechanically deployed in an extended, functional position for use in exercising while working and a concealed in a retracted, stowage position inside the workstation. An illustrative embodiment of the treadmill repositioning and storage system may include a workstation. The workstation may have a workstation desk. A treadmill may be selectively extendable from and retractable into the workstation. In the extended position of the treadmill, a user may walk on the treadmill as the user accesses the workstation desk of the workstation to work or perform various other tasks. The system may thus enable the user to acquire the benefits of exercise while performing work at the workstation desk. The treadmill may be selectively retracted into the workstation when not in use, typically for space-saving purposes.

BRIEF DESCRIPTION OF THE DRAWINGS

Illustrative embodiments of the disclosure will now be described, by way of example, with reference to the accompanying drawings, in which:

FIG. 23 is a sectional view of the treadmill in the extended, functional position, with the front end of the treadmill at an initial treadmill position of a treadmill traversal path which defines movement of the front treadmill end of the treadmill from the functional position to the stowage position in the workstation;

FIG. 24 is a sectional view of the treadmill at an intermediate position between the functional position and the stowage position, with the front treadmill end of the treadmill between the initial treadmill position and a final treadmill position on the treadmill traversal path:

FIG. 25 is a sectional view of the treadmill at the stowage position in the treadmill support structure of the workstation, with the front treadmill end of the treadmill at the final treadmill position and the rear treadmill end of the treadmill at the initial treadmill position on the treadmill traversal path;

DETAILED DESCRIPTION

Figures 1, 2, 3:
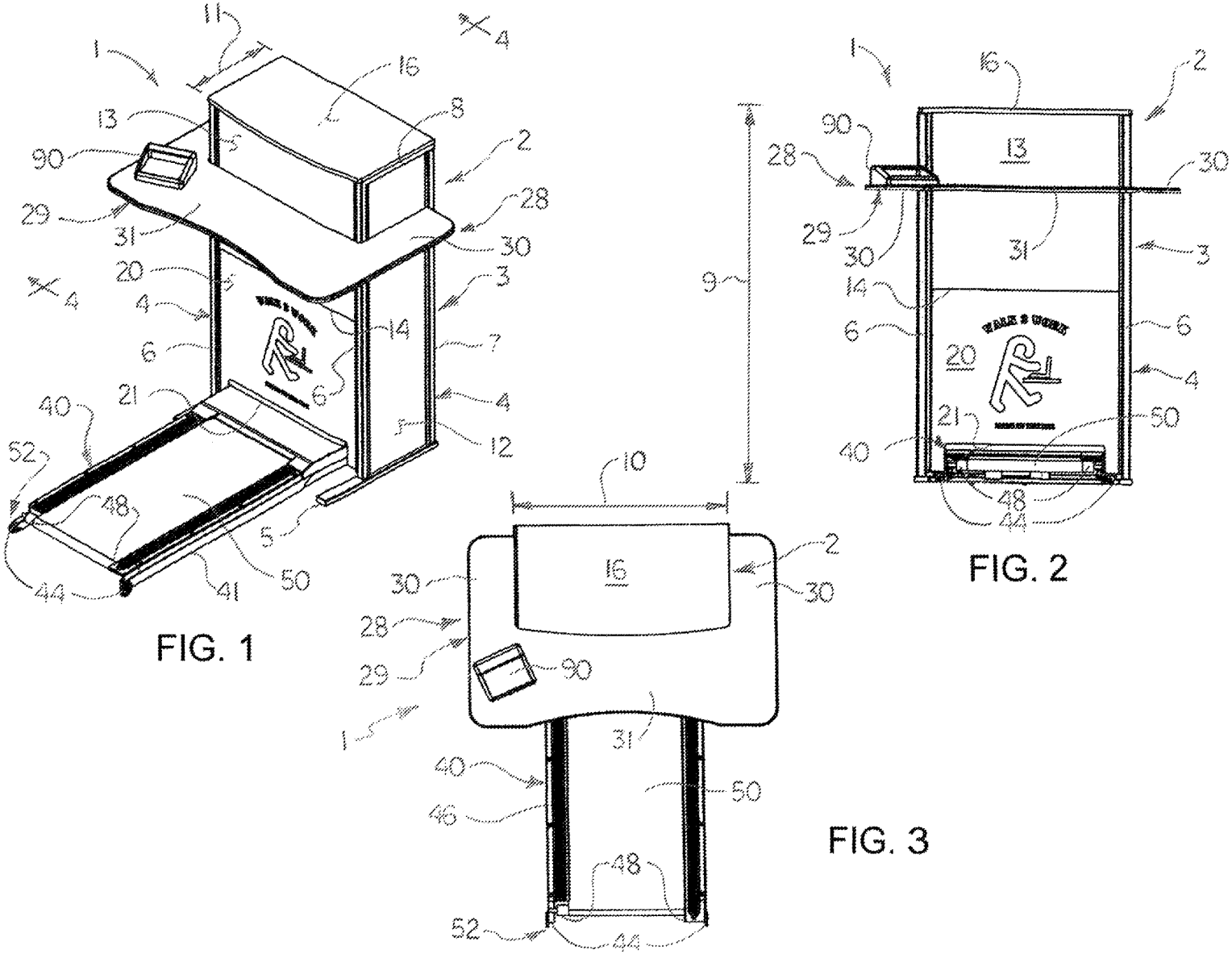
FIG. 1 is a front perspective view of an illustrative embodiment of the treadmill repositioning and storage system, with a treadmill deployed in an extended, functional position from a workstation of the system.
FIG. 2 is a front view of the illustrative treadmill repositioning and storage system illustrated in FIG. 1.
FIG. 3 is a top view of the illustrative system illustrated in FIG. 1.
Figure 5:
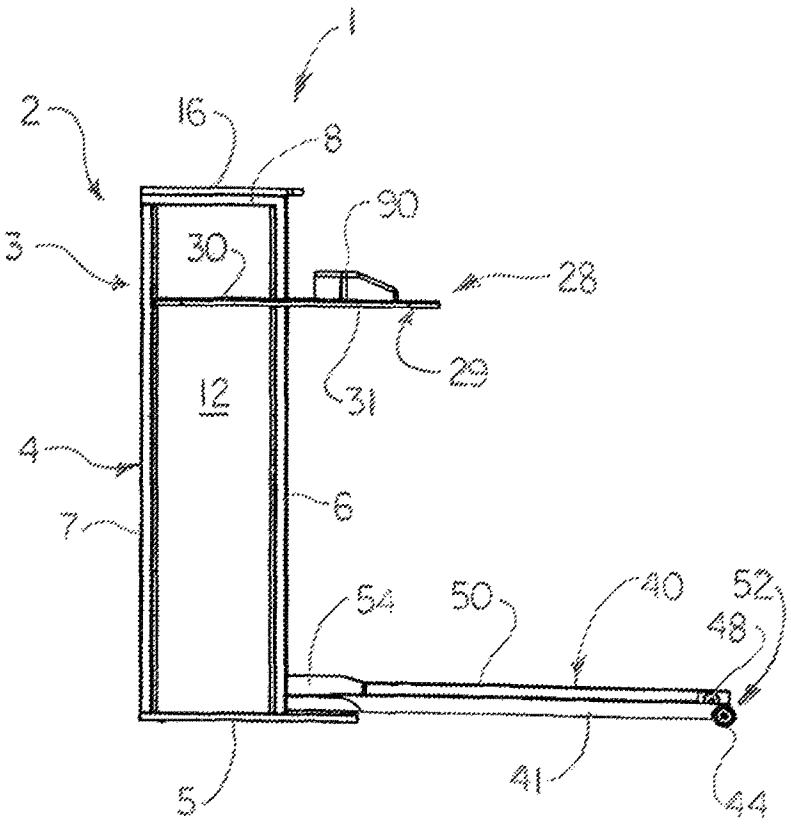
FIG. 5 is a right-side view of the illustrative system illustrated in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-26 and 29-32 of the drawings, an illustrative embodiment of a treadmill repositioning and storage system, hereinafter system, is generally indicated by reference numeral 1. The system 1 may include a workstation 28. The workstation 28 may have a workstation desk 29. As will be hereinafter described, a treadmill 40 may be selectively extendable from and retractable into the workstation 28. In the extended position of the treadmill 40, a user (not illustrated) may walk on the treadmill 40 as the user accesses the workstation desk 29 of the workstation 28 to work or perform various other tasks. The system 1 may thus enable the user to acquire the benefits of exercise while performing work at the workstation desk 29. The treadmill 40 may be selectively retracted into the workstation 28 when not in use, typically for space-saving purposes.

The workstation 28 of the system 1 may include a treadmill support structure 2. The support structure 2 may include any structure or combination of structures, components, or elements which are suitable for supporting the treadmill 40 as the treadmill 40 deploys between the functional and stowage positions. For example and without limitation, in some embodiments, the treadmill support structure 2 may include an enclosure. In other embodiments, the treadmill support structure 2 may include a frame and/or other open structure. As an enclosure, the treadmill support structure 2 may have a box-shaped configuration. Accordingly, the treadmill support structure 2 may include a support structure front 13. A support structure rear 15 (FIG. 4) may be spaced-apart from the support structure front 13. A pair of spaced-apart, parallel support structure sides 12 may extend between the support structure front 13 and the support structure rear 15. A support structure top 16 may be provided on the support structure sides 12, the support structure front 13, and the support structure rear 15.

Figure 4:
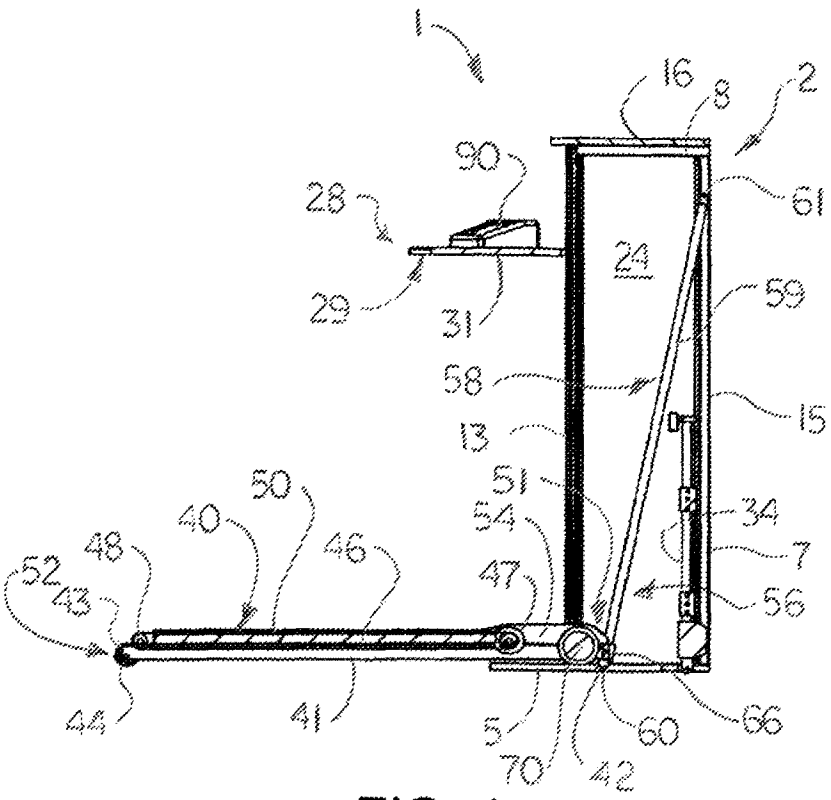
FIG. 4 is a sectional view, taken along section lines 4-4 in FIG. 1, of the illustrative system.

The treadmill support structure 2 may have a support structure interior 24. The support structure interior 24 may be suitably sized and configured to accommodate the treadmill 40 in its stowage position. As illustrated in FIG. 4, in embodiments in which the treadmill support structure 2 is an enclosure, a support structure interior 24 may be formed by and between the support structure sides 12, the support structure front 13, the support structure rear 15, and the support structure top 16.

In some embodiments, the treadmill support structure 2 may have an elongated, rectangular box-shaped configuration. Accordingly, as illustrated in FIGS. 1-3, the treadmill support structure 2 may have a treadmill support structure height 9 (FIG. 2), a treadmill support structure width 10 (FIG. 3), and a treadmill support structure depth 11 (FIG. 1). The treadmill support structure height 9 may be greater than the treadmill support structure width 10 and the treadmill support structure depth 11. In other embodiments, the treadmill support structure height 9 may be less than the treadmill support structure width 10 of the treadmill support structure 2. In some embodiments, the treadmill support structure 2 may have a circular, oval, hexagonal, octagonal, or other polygonal or non-polygonal shape.

In some embodiments, the treadmill support structure 2 may have a support structure frame 3. The support structure sides 12, support structure front 13, support structure rear 15, and support structure top 16 may be formed by respective side, front, rear, and top panels which may be supported by the support structure frame 3. In some embodiments, the support structure frame 3 of the treadmill support structure 2 may have a pair of elongated, rectangular, parallel, spaced-apart side frame portions 4. Each side frame portion 4 may have a frame foot 5 which rests on the floor or other supporting surface. A front frame member 6 and a rear frame member 7 may extend upwardly from the frame foot 5 typically in parallel, spaced-apart relationship to each other. A top frame member 8 may span the front frame member 6 and the rear frame member 7 typically in spaced-apart, parallel relationship to the frame foot 5. Accordingly, each support structure side 12 may be supported by and between the frame foot 5, the front frame member 6, the rear frame member 7, and the top frame member 8 of each corresponding side frame portion 4. The support structure front 13 may be supported by and between the front frame members 6 of the respective side frame portions 4. The support structure rear 15 may be supported by and between the rear frame members 7 of the respective side frame portions 4. The support structure top 16 may be supported by the top frame members 8 of the respective side frame portions 4.

In alternative embodiments, the support structure frame 3 may be omitted from the treadmill support structure 2. Accordingly, the support structure sides 12, support structure front 13, support structure rear 15, and support structure top 16 may be directly attached to each other via brackets and fasteners or molded in one piece according to the knowledge of those skilled in the art, for example and without limitation. The support structure sides 12, support structure front 13, support structure rear 15, and support structure top 16 of the treadmill support structure 2 may be fabricated of wood, metal, plastic, composites, fiberglass, plywood, other materials, or combinations thereof.

A treadmill opening 14 may be provided in the support structure front 13 of the treadmill support structure 2. The treadmill opening 14 may communicate with the support structure interior 24. The workstation desk 29 may be supported by the treadmill support structure 2 above the treadmill opening 14, typically as will be hereinafter described. The workstation desk 29 may protrude forwardly from the support structure front 13 of the treadmill support structure 2. In some embodiments, the workstation desk 29 may have a planar shape or configuration and may include a pair of ledge-shaped side desk portions 30 which protrude from the respective support structure sides 12 of the treadmill support structure 2. A ledge-shaped front desk portion 31 may extend from the side desk portions 30. The front desk portion 31 may protrude forwardly from the support structure front 13 of the treadmill support structure 2. Accordingly, the side desk portions 30 and the front desk portion 31 of the workstation desk 29 may provide a support surface for various items 90 such as a notepad, computer, personal electronic device, pens, paper, and the like.

Figure 26:
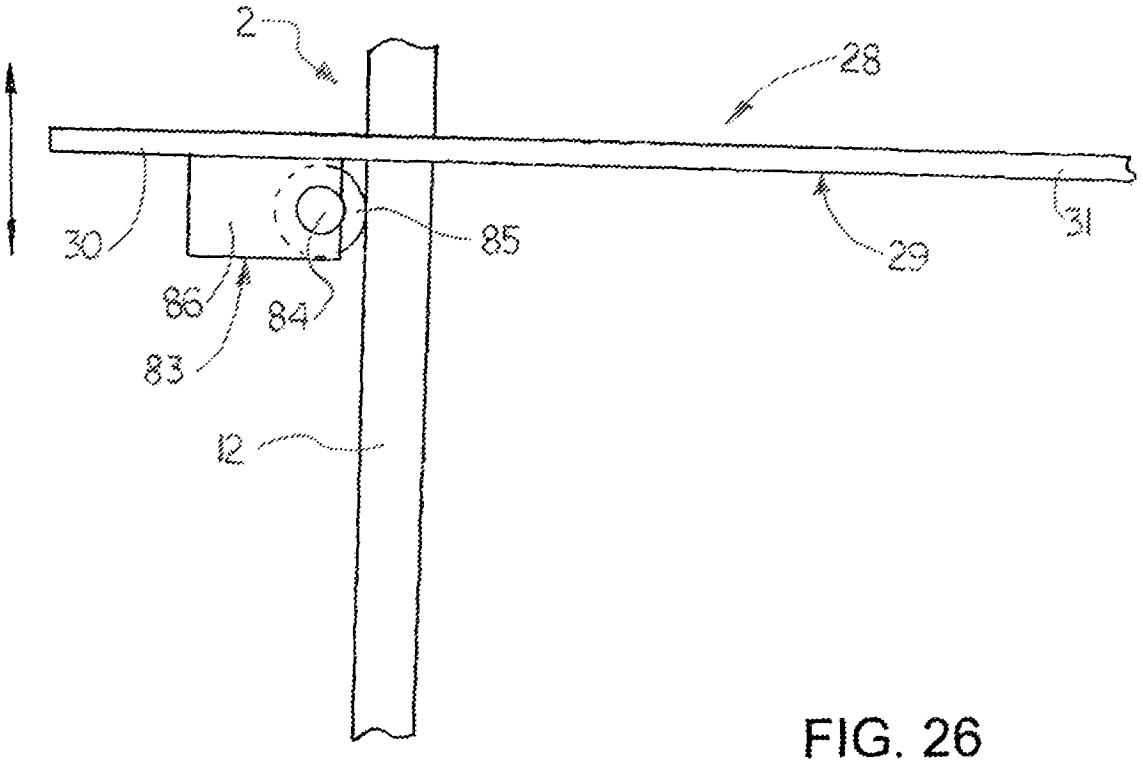
FIG. 26 is a sectional view of a portion of the treadmill support structure of the workstation, more particularly illustrating an exemplary workstation desk actuator for facilitating vertical positioning of the workstation desk on the treadmill support structure of the workstation.

In some embodiments, the workstation desk 29 of the workstation 28 may be vertically adjustable on the treadmill support structure 2 along the support structure front 13. Accordingly, as illustrated in FIG. 26, at least one workstation desk actuator 83 may facilitate vertical adjustment of the workstation desk 29 on the treadmill support structure 2. The workstation desk actuator 83 may have any design which is suitable for the purpose. Accordingly, in some embodiments, the workstation desk actuator 83 may have an actuator housing 86. The actuator housing 86 may be attached to a lower surface of the workstation desk 29 typically using mechanical fasteners (not illustrated) suitable for the purpose. A workstation position motor 84 may be provided in the actuator housing 86. At least one workstation position roller 85 may be drivingly engaged for rotation by the workstation position motor 84. The workstation position roller 85 may engage an exterior surface of the treadmill support structure 2, such as one of the support structure sides 12, for example and without limitation, as illustrated. Accordingly, responsive to operation of the workstation position motor 84, the workstation position roller 85 may raise or lower the workstation desk 29 on the treadmill support structure 2 according to the desires of the user of the system 1.

In some embodiments, a treadmill concealment panel 20 may be supported by the support structure front 13 of the treadmill support structure 2 at the treadmill opening 14. The treadmill concealment panel 20 may be deployable in a lowered position (FIGS. 1 and 2) and in a raised position (FIGS. 13-15) to close and open, respectively, the treadmill opening 14 as the treadmill 40 deploys between the functional position and the stowage position. The treadmill concealment panel 20 may be configured for deployment in the lowered position by gravity and in the raised position as the treadmill 40 deploys from the functional position (FIGS. 1-3), through the intermediate position (FIGS. 13-15) to the stowage position (FIGS. 18-20) and exerts upward pressure against the treadmill concealment panel 20. A treadmill slot 21 may be provided in the lower edge of the treadmill concealment panel 20. The treadmill slot 21 may accommodate the front end portion of the treadmill 40 as the treadmill 40 is disposed in the functional position. In some embodiments, the treadmill concealment panel 20 may be omitted from the treadmill opening 14.

Figure 30:
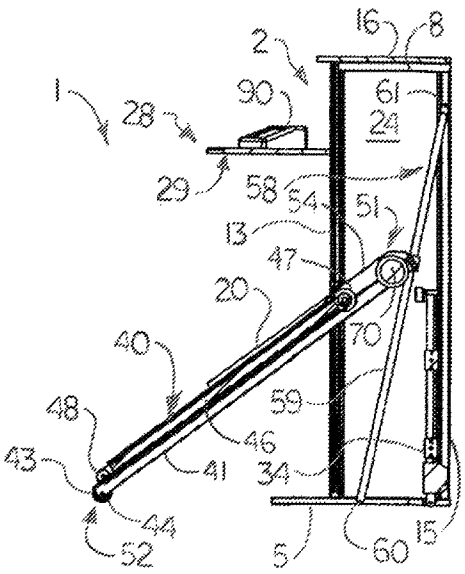
FIG. 30 is a sectional view of the illustrative treadmill repositioning and storage system illustrated in FIG. 29, with the treadmill in the intermediate position.
Figure 32:
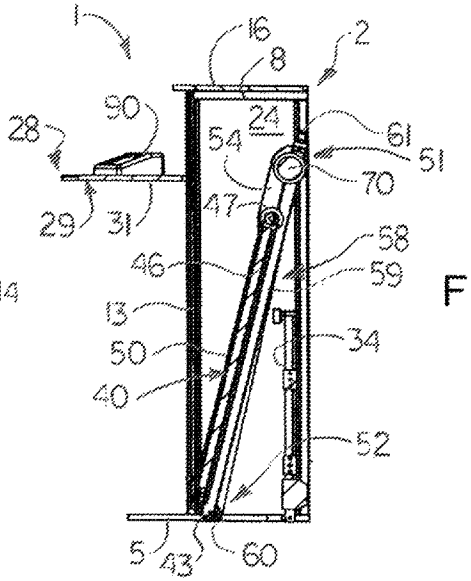
FIG. 32 is a sectional view of the illustrative treadmill repositioning and storage system illustrated in FIG. 29, with the treadmill in the stowage position.
Figure 29:
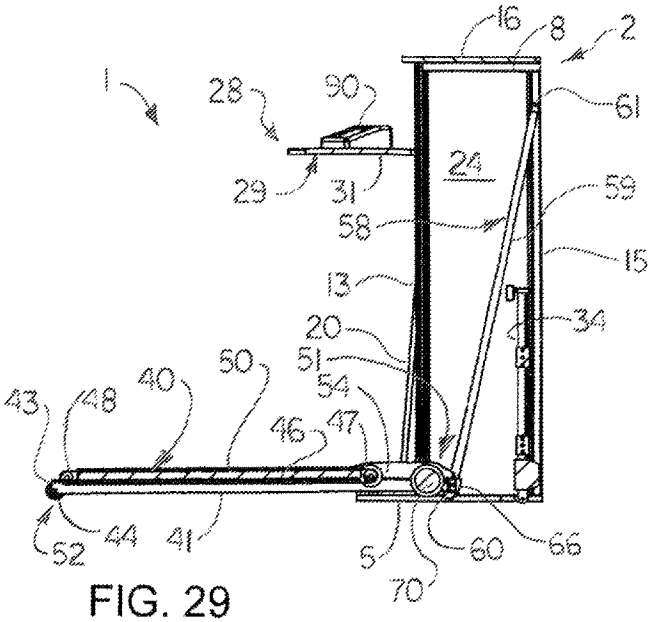
FIG. 29 is a sectional view of the workstation and treadmill of an illustrative embodiment of the treadmill repositioning and storage system, with the treadmill in the functional position, more particularly illustrating a typical hinge technique for pivotally attaching the treadmill concealment panel to the support structure front of the support structure.
Figure 31:
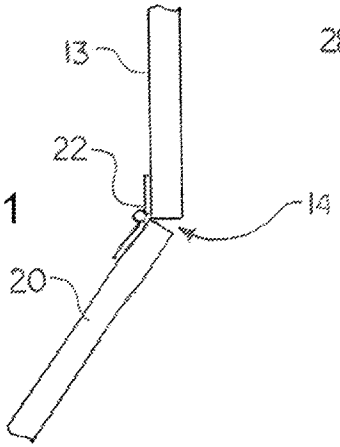
FIG. 31 is an enlarged sectional view illustrating a panel hinge pivotally attaching the treadmill concealment panel to the support structure front of the treadmill support structure.

The treadmill concealment panel 20 may be mounted for deployment in the lower and upper positions to close and open, respectively, the treadmill opening 14 using any mounting technique which is suitable for the purpose. For example and without limitation, in some embodiments, the treadmill concealment panel 20 may be slidably mounted on at least one rail or guide (not illustrated) which may be provided on the interior surface of the support structure front 13. Accordingly, responsive to deployment of the treadmill 40 between the functional and stowage positions, the treadmill concealment panel 20 may deploy between the lowered position and the raised position by sliding on the rail or guide. In some embodiments, a panel containment space (not illustrated) may be provided in the support structure front 13 of the treadmill support structure 2. The panel containment space may be suitably sized and configured to accommodate the treadmill concealment panel 20 in the raised position of the treadmill concealment panel 20. As illustrated in FIGS. 29-31, in some embodiments, at least one panel hinge 22 (FIG. 31) may pivotally attach the upper end of the treadmill concealment panel 20 to the treadmill support structure 2. For example and without limitation, the panel hinge or hinges 22 may attach the treadmill concealment panel 20 to the support structure front 13, or alternatively, to the support structure frame 3 of the treadmill support structure 2. Accordingly, as it deploys from the functional position (FIG. 29) to the stowage position (FIG. 32), the treadmill 40 may cause the treadmill concealment panel 20 to pivot forwardly from the treadmill opening 14, typically parallel to the plane of the treadmill 40, as illustrated in FIG. 30. As the treadmill 40 moves into the stowage position in the support structure interior 24, as illustrated in FIG. 32, the treadmill concealment panel 20 may fall by gravity back into the treadmill opening 14 as it pivots about the panel hinge or hinges 22, thereby concealing the stowed treadmill 40 from view.

Figure 19:
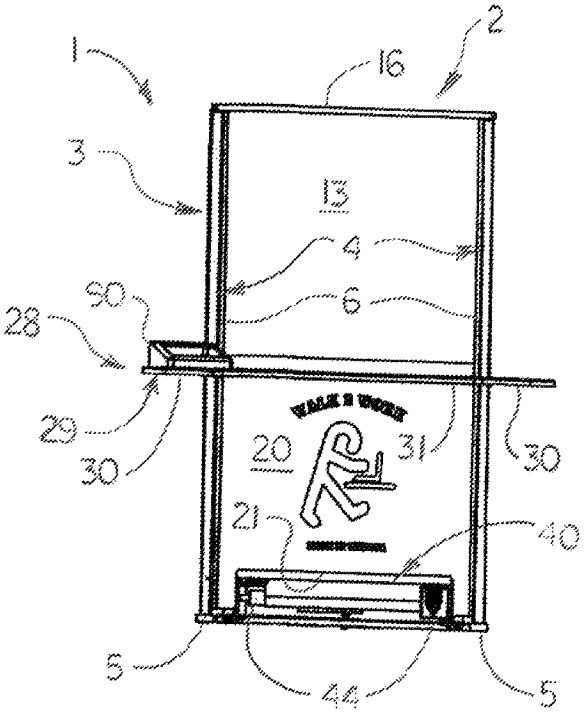
FIG. 19 is a front view of the system illustrated in FIG. 18.
Figure 20:
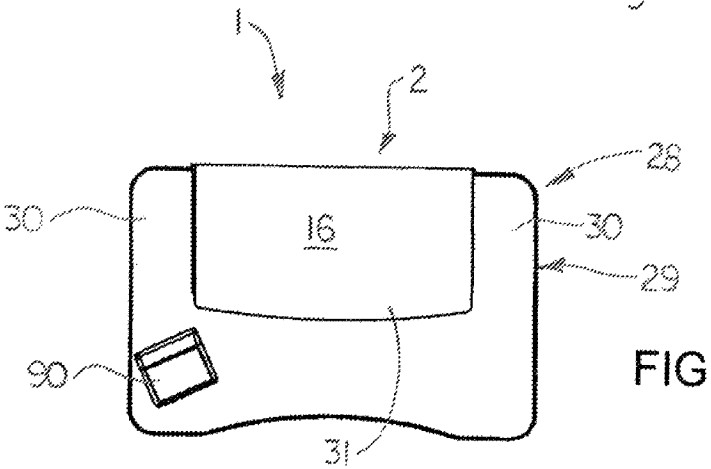
FIG. 20 is a top view of the system illustrated in FIG. 18.
Figure 18:
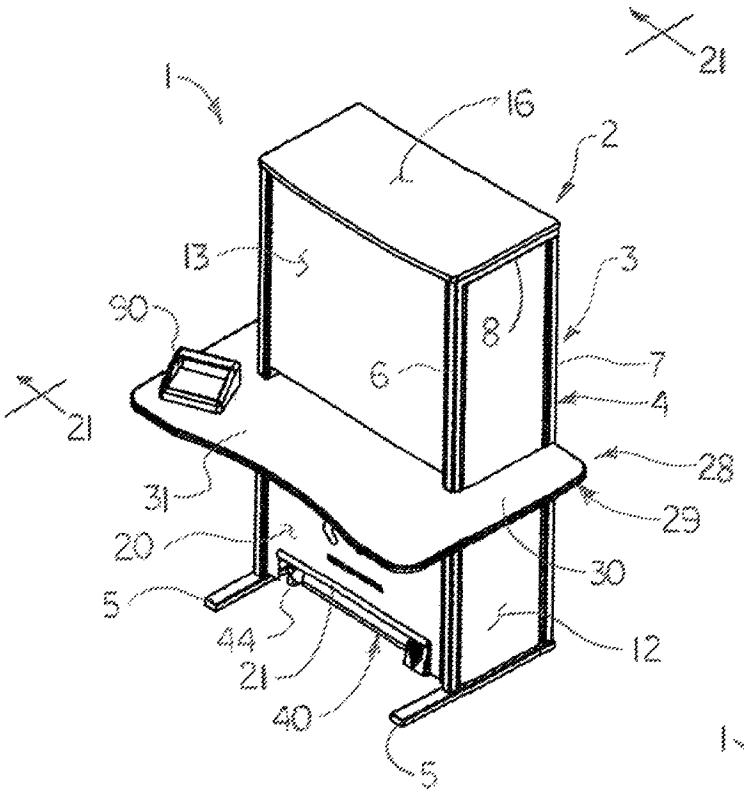
FIG. 18 is a front perspective view of the illustrative treadmill repositioning and storage system, with the treadmill (not illustrated) deployed in the retracted, stowage position in the workstation.
Figure 22:
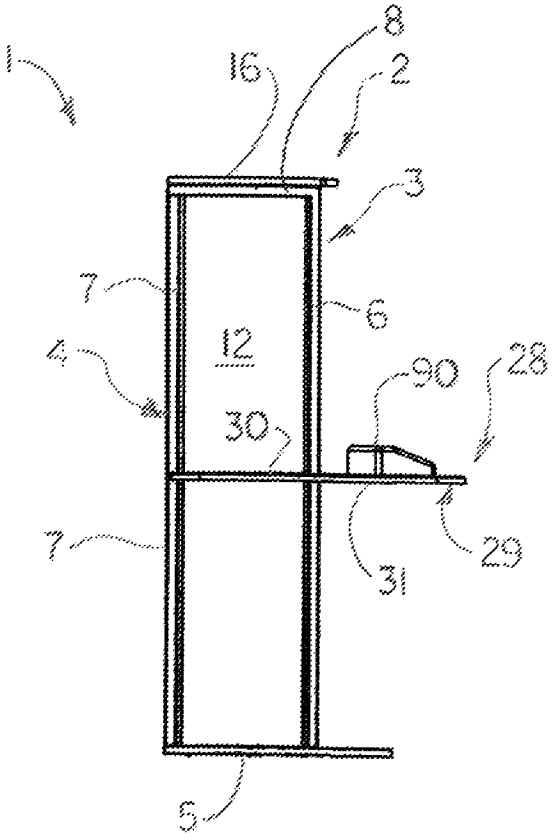
FIG. 22 is a right-side view of the illustrative system illustrated in FIG. 22.

As illustrated in FIGS. 1-3, in the functional position, the treadmill 40 may extend from the support structure interior 24 of the treadmill support structure 2 through the treadmill opening 14. As illustrated in FIGS. 18-20, in the stowage position, the treadmill 40 may be retracted into the treadmill support structure 2. As illustrated in FIGS. 4 and 8-12, a treadmill position actuator 56 may be supported by the treadmill support structure 2 in the support structure interior 24. The treadmill position actuator 56 may be attached to the treadmill 40 and configured to deploy the treadmill 40 between the functional position and the stowage position, typically as will be hereinafter described.

Figure 6:
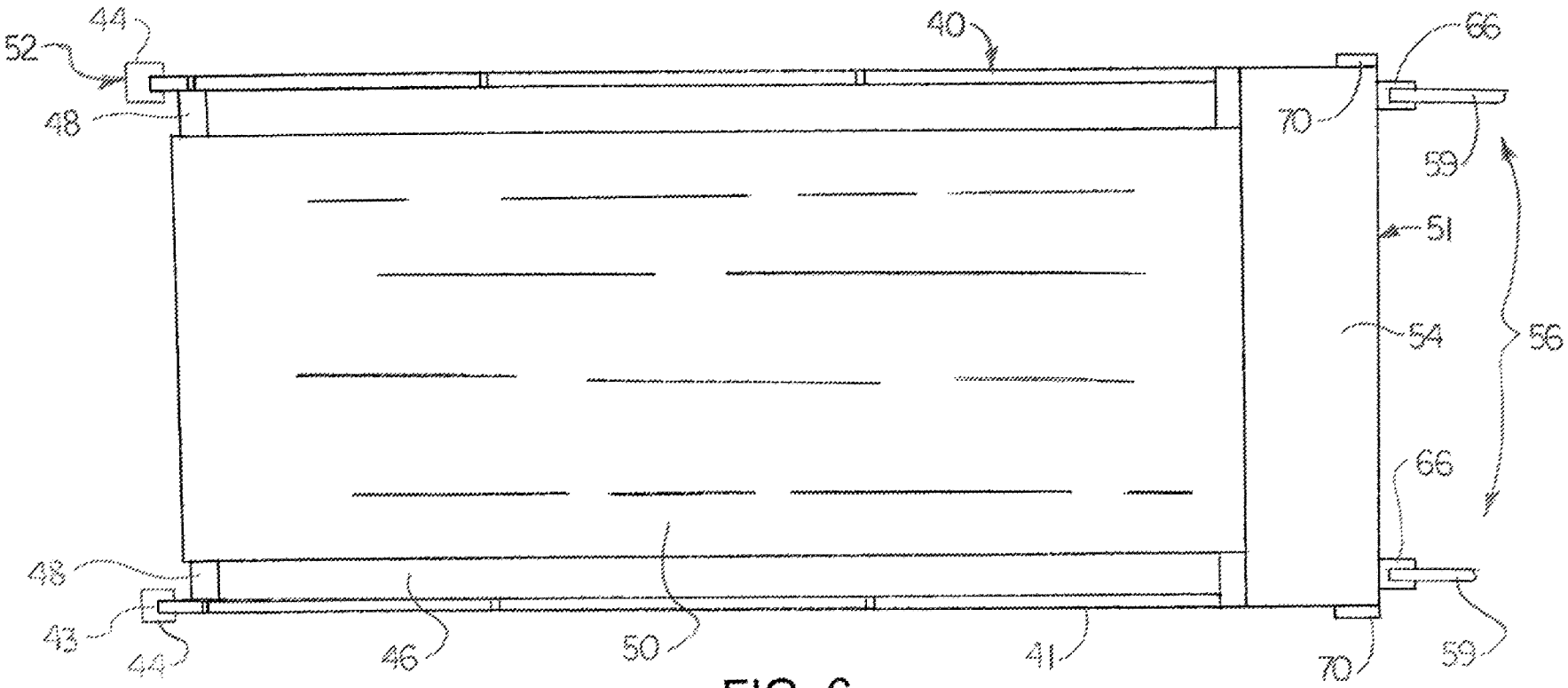
FIG. 6 is a top view of a typical treadmill of the treadmill repositioning and storage system, with a pair of treadmill traversal members (illustrated in section) of a treadmill position actuator attached to the treadmill.
Figure 7:
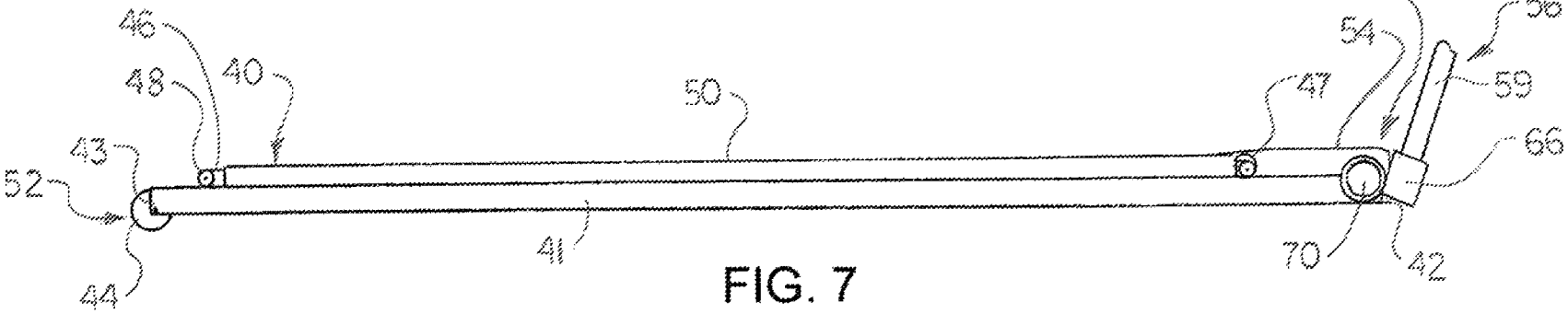
FIG. 7 is a side view of the treadmill illustrated in FIG. 6.

The treadmill 40 of the system 1 may have a design which is substantially the same as or similar to standard or conventional treadmills known by those skilled in the art. Accordingly, as illustrated in FIGS. 6 and 7, the treadmill 40 may include a treadmill frame 41. In some embodiments, the treadmill frame 41 of the treadmill 40 may be elongated and rectangular. The treadmill frame 41 may have a front frame end 42 and a rear frame end 43. A pair of spaced-apart treadmill rollers 44 may be provided at the rear frame end 43 of the treadmill frame 41. The treadmill rollers 44 may facilitate movement of the treadmill 40 on a floor or other supporting surface (not illustrated) as the treadmill 40 is deployed between the functional and stowage positions.

A treadmill platform 46 may be supported by the treadmill frame 41. At least one treadmill motor 47 may be provided at a front platform end of the treadmill platform 46. At least one belt roller 48 may be provided at a rear platform end of the treadmill platform 46. A continuous treadmill belt 50 may traverse the treadmill platform 46. The treadmill belt 50 may be engaged by the treadmill motor 47 and the belt roller 48. Accordingly, responsive to operation of the treadmill motor 47, the treadmill belt 50 may traverse the upper and lower surfaces of the treadmill platform 46 and the belt roller 48 typically in the conventional manner. In some embodiments, the treadmill 40 may include an angle adjustment mechanism (not illustrated) which facilitates angular adjustment of the treadmill platform 46 on the treadmill frame 41 to facilitate selective variation in the slope of the treadmill belt 50, as is known by those skilled in the art.

At least one frame extension 54 may extend forwardly from the treadmill frame 41 of the treadmill 40. The frame extension or extensions 54 may facilitate attachment of the treadmill 40 to the treadmill position actuator or actuators 54, typically as will be hereinafter described. The frame extension or extensions 54 may define a front treadmill end 51, and the treadmill rollers 44 may define a rear treadmill end 52 of the treadmill 40. In some embodiments, the treadmill 40 may be non-folding and unhinged between the front treadmill end 51 and the rear treadmill end 52, as illustrated. The treadmill position actuator 56 may be configured to raise and lower the front treadmill end 51 of the treadmill 40 typically as the treadmill rollers 44 at the rear treadmill end 52 roll along the floor or other support surface of the system 1 and the treadmill 40 deploys from the functional position to the stowage position and from the stowage position to the functional position, respectively, typically as will be hereinafter described.

As illustrated in FIGS. 23-25, in some embodiments, a sloped, planar treadmill traversal path 58 may define movement of the front treadmill end 51 of the treadmill 40 between the functional position and the stowage position. The treadmill position actuator 56 may be attached to the front treadmill end 51 of the treadmill 40, typically as will be hereinafter described, and configured to deploy the treadmill 40 between the functional position and the stowage position along the treadmill traversal path 58. The treadmill traversal path 58 may have an initial treadmill position 60 at the frame foot 5, proximate the support structure front 13, and a final treadmill position 61 at the support structure rear 15, proximate the support structure top 16 of the treadmill support structure 2. As illustrated in FIG. 23, in the functional position of the treadmill 40, the front treadmill end 51 of the treadmill 40 may coincide in position with the initial treadmill position 60. As illustrated in FIG. 25, in the stowage position of the treadmill 40, the front treadmill end 51 of the treadmill 40 may coincide with the final treadmill position 61, whereas the rear treadmill end 52 of the treadmill 40 may coincide in position with the initial treadmill position 60, with the treadmill plane of the treadmill 40 typically disposed substantially parallel to the treadmill traversal path 58. The treadmill plane of the treadmill 40 may thus be sloped or angled from the initial treadmill position 60 to the final treadmill position 61, with the front treadmill end 51 disposed at or adjacent to the support structure rear 15 and the rear treadmill end 52 disposed at or adjacent to the support structure front 13 of the treadmill support structure 2. This trajectory of the treadmill traversal path 58, as well as the relative proximity of the initial treadmill position 60 to the support structure front 13 and the relative proximity of the final treadmill position 61 to the support structure rear 15, may facilitate efficient utilization of space in the support structure interior 24. Consequently, the support structure depth 11 (FIG. 1) of the treadmill support structure 2 may be minimized to optimize utilization of space in the home, business, or other building or space in which the system 1 is deployed.

The treadmill position actuator 56 may include any design and any structure, component, element, or combination of structures, components, or elements which are capable of deploying the treadmill 40 between the functional and stowage positions, typically as the front treadmill end 51 of the treadmill 40 traverses the treadmill traversal path 58. These may include but are not limited to threaded actuators, rack and pinion actuators, cable-operated actuators, belt-operated actuators, and piston actuators. For example and without limitation, as illustrated in FIGS. 4 and 8-11, in some embodiments, the treadmill position actuator 56 may include at least one treadmill traversal member 59. As illustrated in FIG. 6, in some embodiments, the treadmill position actuator 56 may include a pair of spaced-apart treadmill traversal members 59 disposed in spaced-apart relationship to each other at a spacing distance which may generally correspond to the width of the treadmill frame 41 of the treadmill 40. The treadmill traversal members 59 may be disposed at a sloped orientation which corresponds to the treadmill traversal path 58. Accordingly, as illustrated in FIGS. 23-25, the lower end of each treadmill traversal member 59 may correspond to the initial treadmill position 60, whereas the upper end of each treadmill traversal member 59 may correspond to the final treadmill position 61, of the treadmill traversal path 58.

At least one, and typically, a pair of frame collars 66 may be provided on the frame extension or extensions 54 of the treadmill frame 41. The frame collars 66 may be pivotally attached to the frame extensions 54 according to the knowledge of those skilled in the art. In some embodiments, each frame collar 66 may engage and may be configured to traverse the corresponding treadmill traversal member 59 responsive to rotation of the frame collar 66, typically as will be hereinafter described, to facilitate deployment of the treadmill 40 between the functional and stowage positions. At least one, and typically, a pair of treadmill position motors 70 may be provided on the frame extension or extensions 54 of the treadmill frame 41. Each treadmill position motor 70 may drivingly engage the corresponding frame collar 66 for rotation of the frame collar 66 on the corresponding treadmill traversal member 59 typically as will be hereinafter described.

Figure 9:
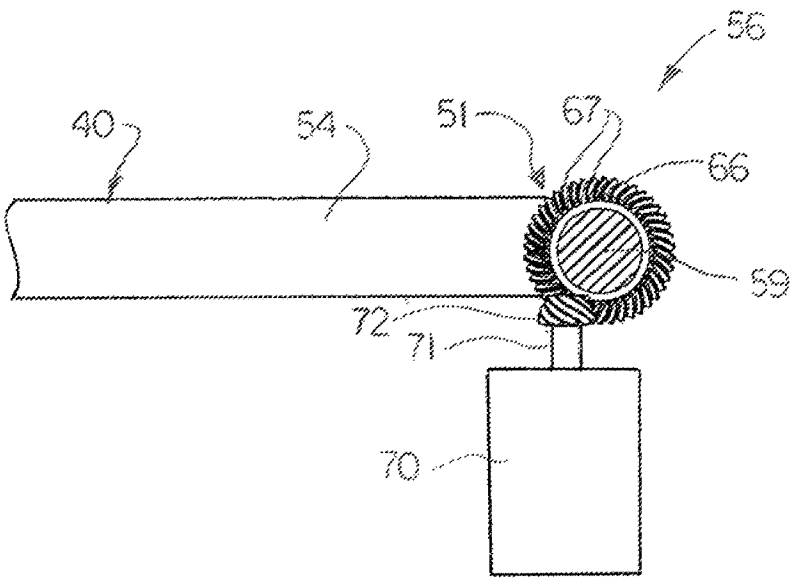
FIG. 9 is a top view of the treadmill position actuator illustrated in FIG. 8.
Figure 8:
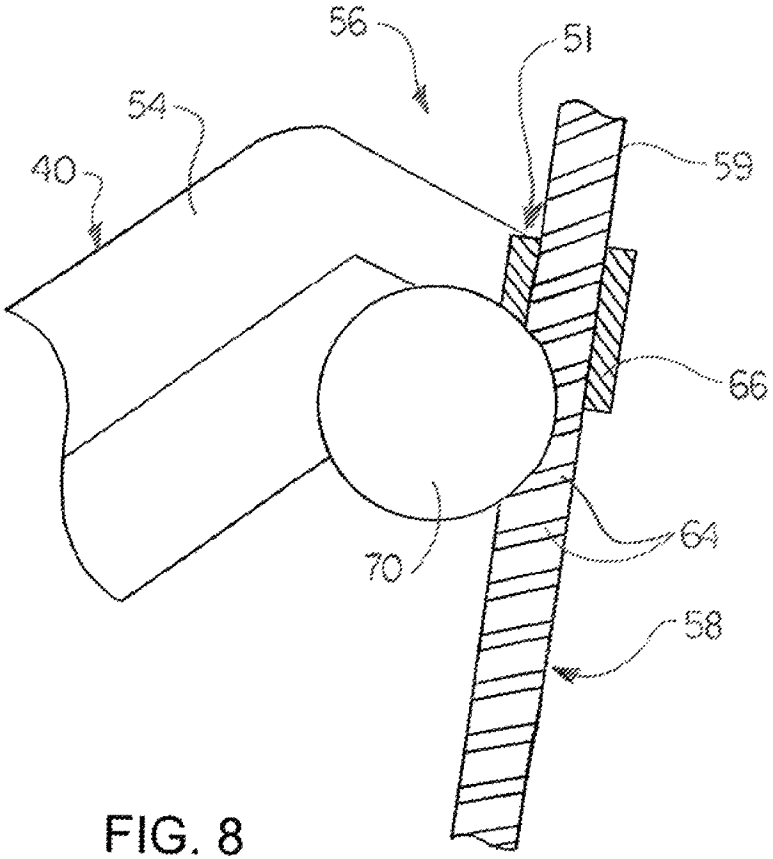
FIG. 8 is an enlarged sectioned side view of a typical treadmill position actuator operable to deploy the treadmill between the functional position and the stowage position with respect to the workstation.

As illustrated in FIGS. 8 and 9, in some embodiments, each frame collar 66 of the treadmill position actuator 56 may threadably engage the corresponding treadmill traversal member 59. Accordingly, the frame collar 66 may have interior collar threads (not illustrated) which threadably engage companion exterior support member threads 64 on the treadmill traversal member 59. Rotation of the frame collar 66 in the clockwise and counterclockwise directions may thus facilitate bidirectional traversal of the frame collar 66 along the treadmill traversal member 59 for deployment of the treadmill 40 between the functional and stowage positions.

As illustrated in FIG. 9, in some embodiments, the treadmill position motor 70 may drivingly engage the frame collar 66 through a gear drive which is suitable for the purpose. Accordingly, in some embodiments, the gear drive may include a motor shaft 71 which is drivingly engaged for rotation by the treadmill position motor 70. A motor gear 72, which may be a bevel gear, as illustrated, for example and without limitation, may be drivingly engaged for rotation by the motor shaft 71. Exterior collar teeth 67 may be provided on the frame collar 66. The motor gear 72 may mesh with the collar teeth 67 on the frame collar 66 such that the motor gear 72 transits rotation from the motor shaft 71 to the frame collar 66 via the collar teeth 67.

Figure 11:
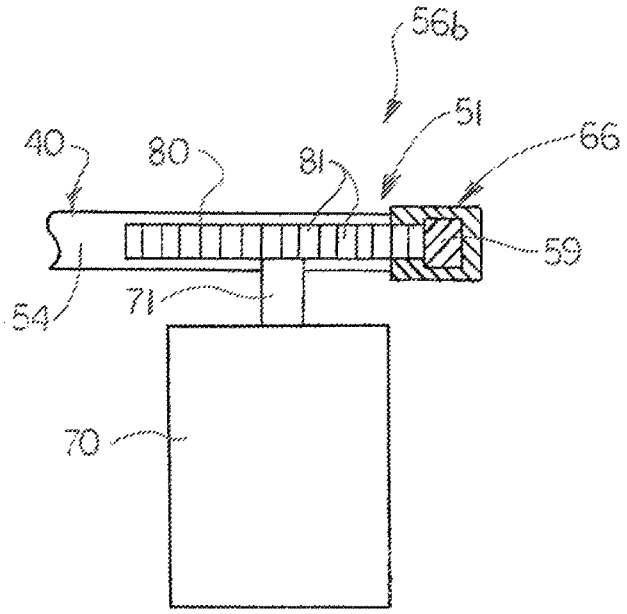
FIG. 11 is a top view of the treadmill position actuator illustrated in FIG. 10.
Figure 10:
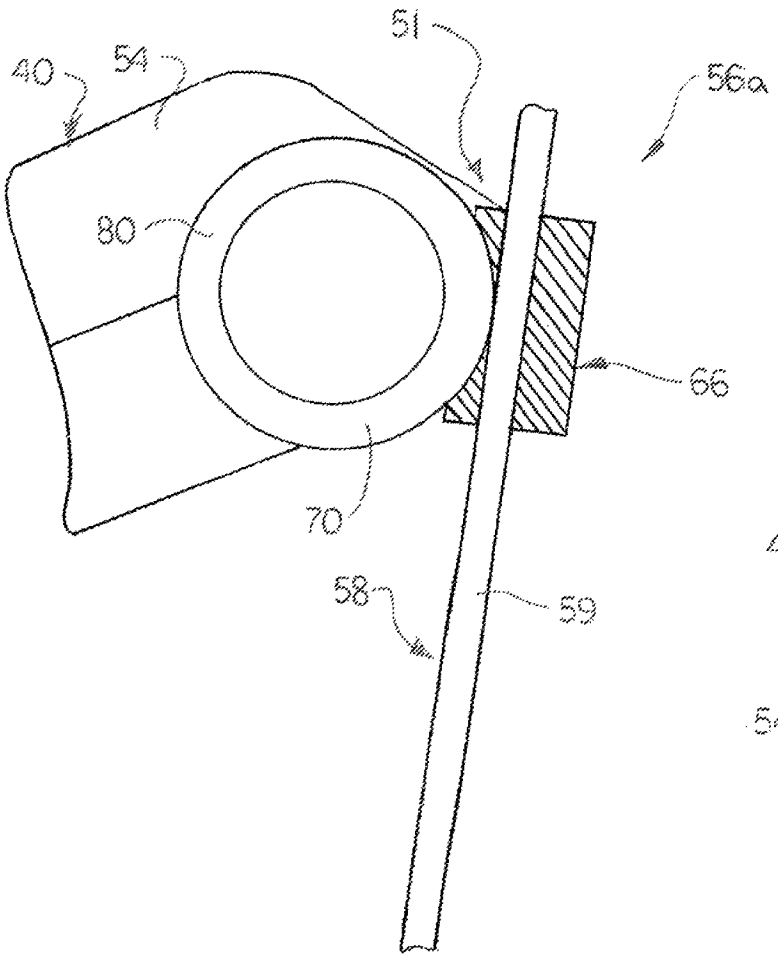
FIG. 10 is an enlarged sectioned side view of another treadmill position actuator.

As illustrated in FIGS. 10 and 11, in some embodiments, each treadmill position motor 70 of an alternative illustrative treadmill position actuator 56*a* may include a rack and pinion arrangement. Accordingly, a pinion 80 having pinion teeth 81 may be drivingly engaged for rotation by the motor shaft 71 of the treadmill position motor 70. The frame collar 66 may rotatably support the pinion 80 and maintain the pinion teeth 81 on the pinion 80 in meshing engagement with companion rack teeth (not illustrated) on the treadmill traversal member 59. Accordingly, responsive to operation of the treadmill position motor 70, the motor shaft 71 may rotate the pinion 80 such that the pinion teeth 81 progressively mesh with the companion rack teeth on the treadmill traversal member 50 and the treadmill 40 deploys between the functional position and the stowage position.

Figure 12:
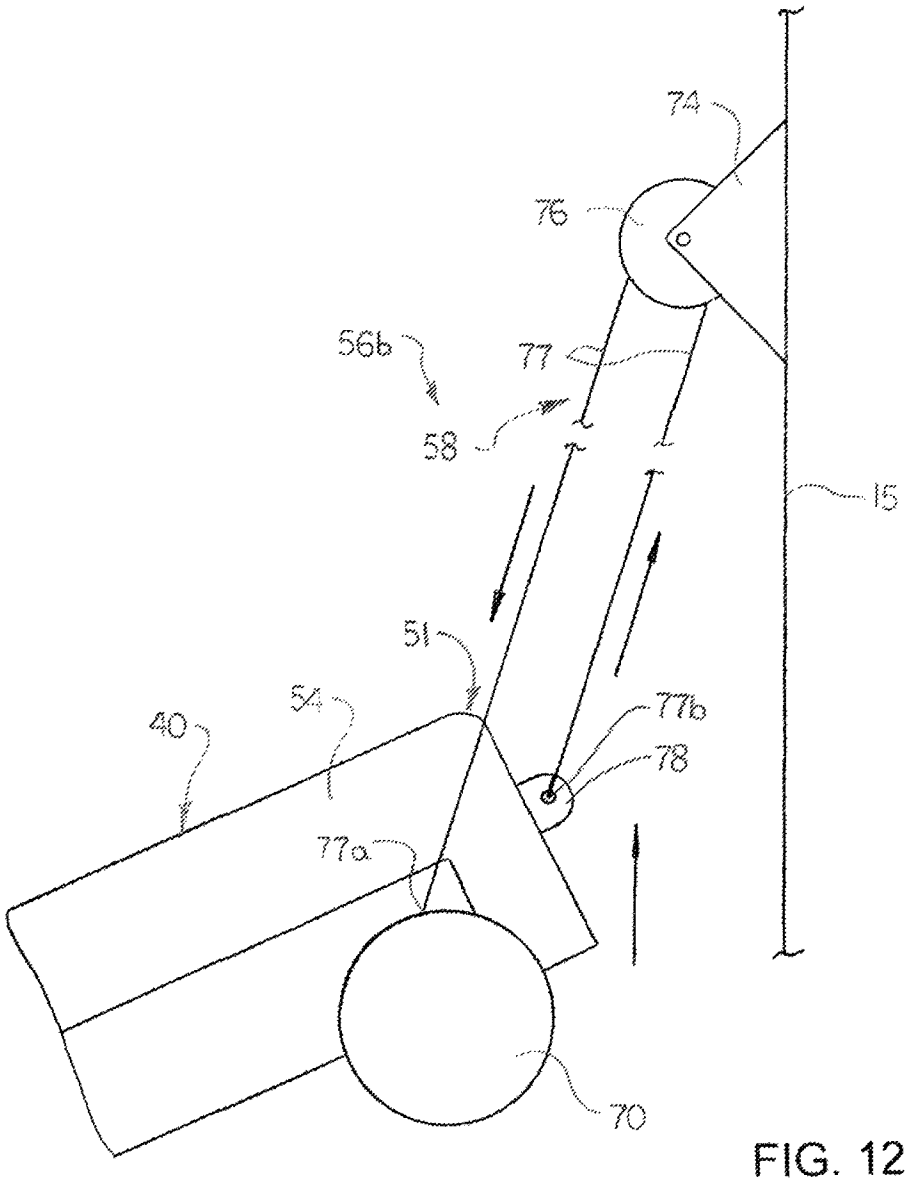
FIG. 12 is an enlarged sectioned side view of another treadmill position actuator suitable for deployment of the treadmill between the functional position and the stowage position.
Figure 14:
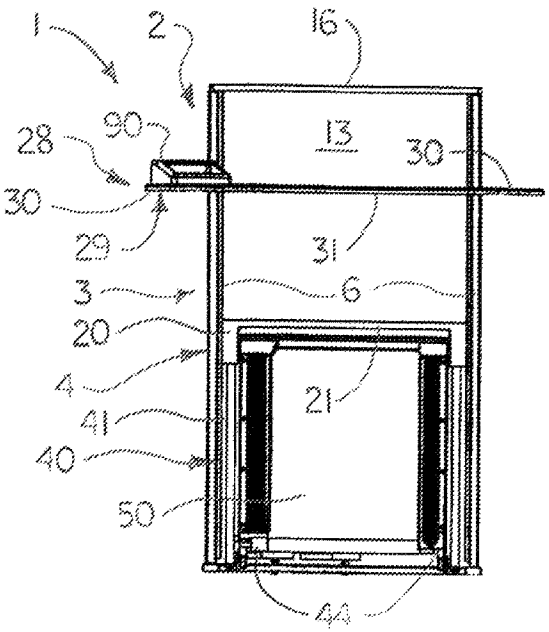
FIG. 14 is a front view of the system illustrated in FIG. 13.
Figure 15:
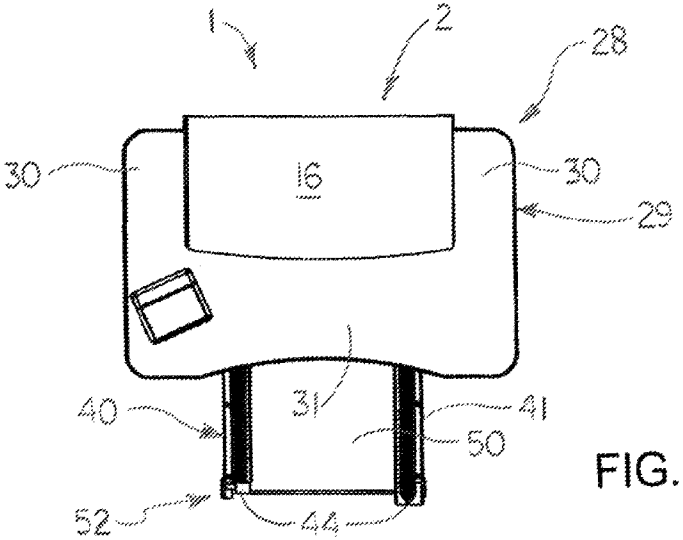
FIG. 15 is a top view of the system illustrated in FIG. 13.
Figure 13:
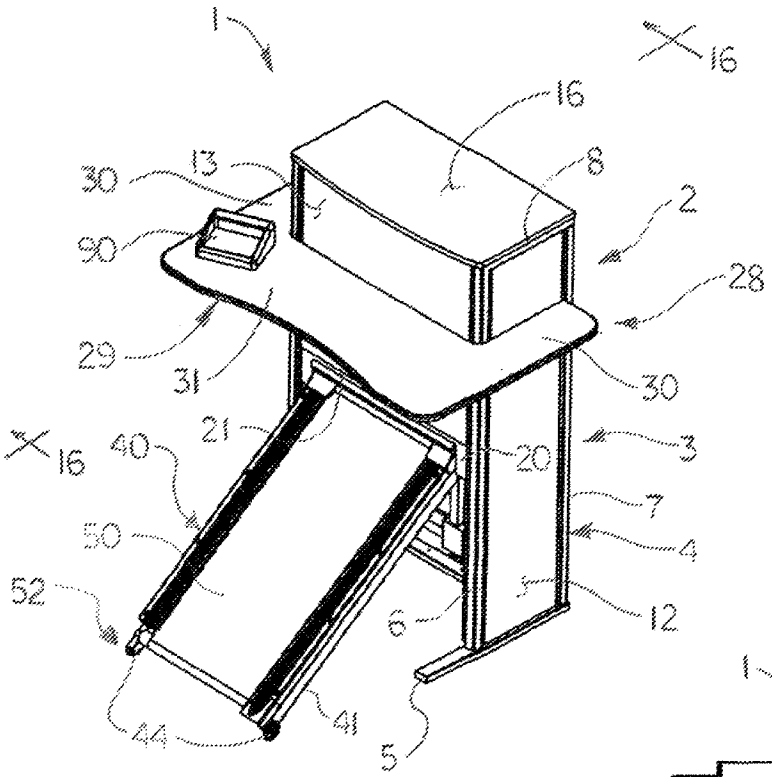
FIG. 13 is a front perspective view of the illustrative treadmill repositioning and storage system, with the treadmill deployed in a position which is intermediate the extended, functional position and the retracted, stowage position.
Figure 17:
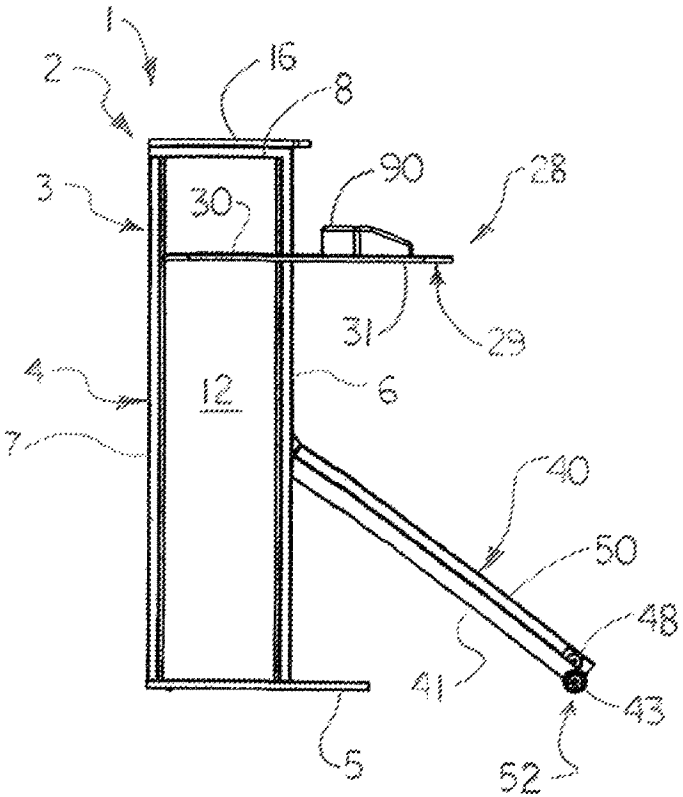
FIG. 17 is a right-side view of the illustrative system illustrated in FIG. 13.

As illustrated in FIG. 12, in some embodiments, each treadmill position motor 70 of another alternative illustrative treadmill position actuator 56*b* may include a pulley arrangement. Accordingly, at least one treadmill pulley 76 may be attached to the treadmill support structure in the support structure interior 24. For example and without limitation, in some embodiments, the treadmill pulley 76 may be rotatably attached to the support structure rear 15, proximate the support structure top 16, via a pulley bracket 74. At least one hoist cable 77 may have a first cable end 77*a* engaged by the treadmill position motor 70. The hoist cable 77 may engage the treadmill pulley 76, and a second cable end 77*b* of the hoist cable 77 may be attached to the frame extension 54 of the treadmill 40 such as via a cable flange 78. The hoist cable 77 may be configured to deploy the treadmill 40 between the functional position and the stowage position responsive to operation of the treadmill position motor 70. In still other embodiments, the treadmill position actuator 56 may include belts and/or electric, pneumatic, and or hydraulic pistons or the like which actuate the treadmill 40 between the functional and stowage positions.

Figure 27:
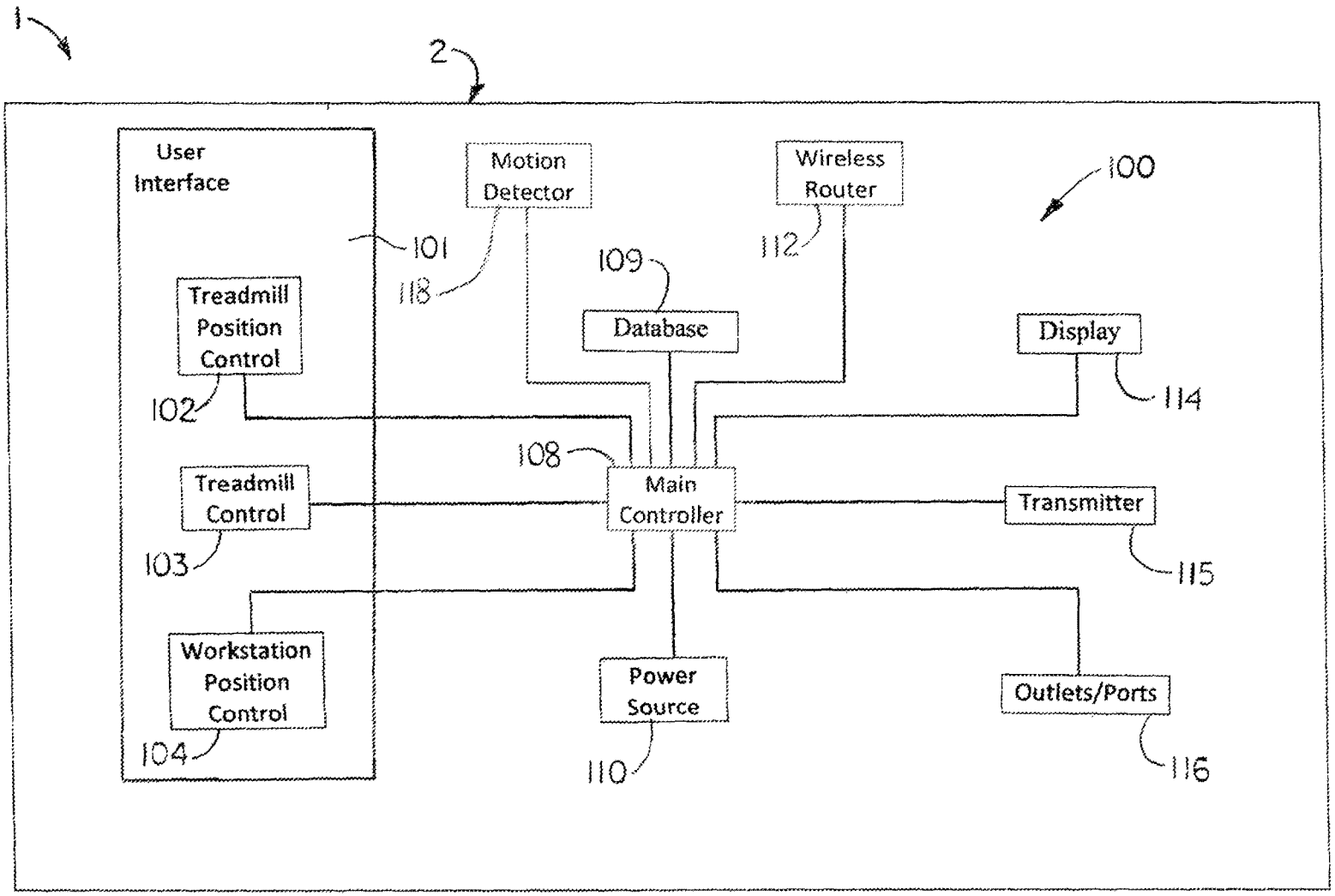
FIGS. 27 and 28 are block diagrams of a typical control system for control of the various functional components of the treadmill repositioning and storage system.
Figure 28:
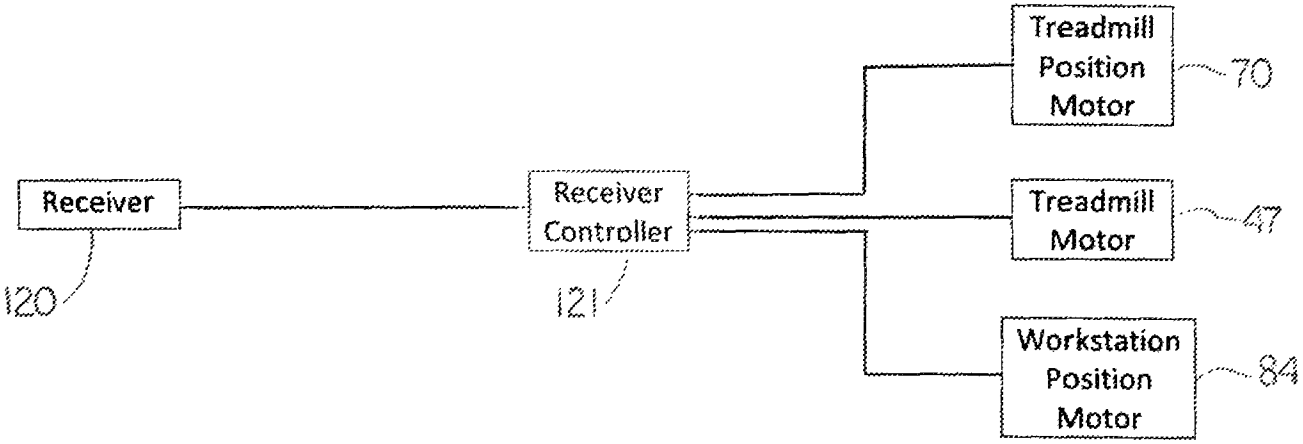

Referring next to FIGS. 27 and 28 of the drawings, a typical control system which is suitable for controlling the various functional components of the storage system 1 is generally indicated by reference numeral 100. The control system 100 may include at least one user interface 101. The user interface 101 may include a treadmill position control 102. The treadmill position control 102 may operably interface with each treadmill position motor 70 of the treadmill position actuator 56, typically as will be hereinafter described. In some embodiments, the user interface 101 may include a treadmill control 103 which operably interfaces with the treadmill motor 47 of the treadmill 40. Additionally or alternatively, the user interface 101 may include a workstation position control 104. The workstation position control 104 may operably interface workstation position motor 84 (FIG. 26) of the workstation desk actuator 83.

Each of the treadmill position control 102, the treadmill control 103, and the workstation position control 104 of the user interface 101 may include at least one button, switch, touchscreen display, and/or other control feature or features known by those skilled in the art. One or more features of the user interface 101 may be provided in any suitable accessible location on the workstation 28. For example and without limitation, the treadmill position control 102, the treadmill control 103, and/or the workstation position control 104 may be provided on the support structure top 16, the support structure front 13, one or both of the support structure sides 12, and/or the workstation desk 29. These locations may enable the user to manipulate the user interface 101 while walking on the treadmill 40 while the treadmill 40 is deployed in the functional position.

The control system 100 may further include at least one main controller 108. The main controller 108 may operably interface with the treadmill position control 102, the treadmill control 103, and the treadmill position control 104. At least one power source 110 may electrically interface with the main controller 108. In some embodiments, the power source 110 may include a standard, 120-volt household outlet (not illustrated). Additionally or alternatively, the power source 110 may include one or more batteries (not illustrated) which may be rechargeable.

In some embodiments, at least one transmitter 115 may operably interface with the main controller 108. The transmitter 115 may wirelessly communicate with a receiver 120 (FIG. 28) such as through a wireless RF (Radio Frequency) signal. Accordingly, in some embodiments, the transmitter 115 may be configured to transmit a wireless activation signal to the receiver 120. In some embodiments, the wireless activation signal may be a Bluetooth signal.

A receiver controller 121 may operably interface with the receiver 120. The treadmill position motor 70, the treadmill motor 47, and the workstation position motor 84 may operably interface with the receiver controller 121. Accordingly, responsive to receiving the wireless activation signal from the transmitter 115 (FIG. 27), via the receiver 120, the receiver controller 121 may be configured to activate the treadmill position motor 70 via user manipulation of the treadmill position control 102, the treadmill motor 47 via user manipulation of the treadmill control 103, and/or the workstation position motor 84 via user manipulation of the workstation position control 104 of the user interface 101. In some embodiments, the receiver controller 121 may be hardwired to the main controller 108 according to the knowledge of those skilled in the art.

As further illustrated in FIG. 27, in some embodiments, at least one database 109 may interface with the controller 108. The database 109 may be configured to store activity data such as data which relates to sitting, standing, and walking statistics, for example and without limitation.

At least one display 114 may interface with the main controller 108. The display 114 may be configured to indicate the data in a selected format. In some embodiments, the display 114 may include a touchscreen display which may form a part of the user interface 110 and facilitates control of the treadmill position motor 70, the treadmill motor 47, and/or the workstation position motor 84 and/or facilitates input of data into the database 109.

In some embodiments, at least one outlet and/or port 116 may interface with the controller 108. The outlet and/or port 116 may include at least one electrical outlet and/or at least one data port such as a USB port, for example and without limitation. The electrical outlet or outlets may include standard 120-volt outlets known by those skilled in the art. The electrical outlet or outlets and/or data ports may be provided in any suitable accessible location or position on the treadmill support structure 2, such as on one of the support structure sides 12, the support structure front 13, the support structure rear 15, the support structure top 16 and/or the workstation desk 29. The data port or ports may be configured to facilitate transfer of data between an electronic device (not illustrated) such as a computer, smartphone, tablet computer, personal digital assistant (PDA), or the like and the database 109. The data port or ports may additionally or alternatively be configured to facilitate electrical charging of the electronic device by transfer of electrical current from the power source 110 typically via the main controller 108.

As further illustrated in FIG. 27, in some embodiments, at least one wireless router 112 may operably interface with the main controller 108. The wireless router 112 may be configured to provide Wi-Fi connectivity for Internet-capable electronic devices.

In some embodiments, at least one motion detector 118 may interface with the main controller 108. The motion detector 118 may be provided on the treadmill support structure 2 and directed towards the treadmill 40 when the treadmill 40 is deployed in the functional position. The main controller 108 may be configured to detect the presence or absence of the user as the user stands or walks on the treadmill 40. The main controller 108 may be further configured to terminate operation of the treadmill motor 47 in the event that the main controller 108 does not detect the presence of the user on the treadmill 40, for safety purposes.

Referring again to FIGS. 4, 15, and 21 of the drawings, in some embodiments, at least one electrical access panel 34 may be provided in the support structure interior 24 of the treadmill support structure 2. The electrical access panel 34 may contain at least some of the components of the control system 100 (FIGS. 27 and 28). The electrical access panel 34 may be provided in any suitable accessible location or position in the support structure interior 24. For example and without limitation, in some embodiments, the electrical access panel 34 may be provided on the interior surface of the support structure rear 15 of the treadmill support structure 2, as illustrated. The electrical access panel 34 may include a cabinet having a cabinet interior sized and configured to contain the components, with an openable and closeable door on the cabinet. The cabinet door may open to the support structure interior 24 and/or the exterior of the treadmill support structure 2.

Referring again to FIGS. 1-5, 13-25, in typical application of the system 1, the treadmill support structure 2 may be placed on a floor or other supporting surface (not illustrated) in a home, office, or other building. The treadmill 40 may normally be deployed in the stowage position illustrated in FIGS. 18-22 for space-saving considerations. A user (not illustrated) may stand in front of the treadmill support structure 2 and use the workstation desk 29 of the workstation 28 as the user performs various tasks while typically using the workstation desk 29 and/or the support structure top 16 of the treadmill support structure 2 as a support surface for papers, pens, pencils, writing tablets or pads, laptop computers, personal electronic devices, or the like. The wireless router 112 (FIG. 27) may provide Wi-Fi access to one or more electronic devices. One or more of the electronic devices may be plugged into an outlet/port 116 (FIG. 27) on the treadmill support structure 2. In some applications, the user may place a chair (not illustrated) in front of the workstation 28 and perform the tasks while sitting or may alternate between standing and sitting. In many cases, however, the user may elect to stand while performing the tasks due to the positive health implications of standing rather than sitting for prolonged periods of time.

In some applications, the user may selectively adjust the vertical height or position of the workstation desk 29 typically by appropriate manipulation of the workstation position control 104 (FIG. 27) of the user interface 101. The main controller 108 may responsively cause the transmitter 115 to emit a wireless activation signal which is received by the receiver 120 (FIG. 28). The receiver controller 121 (FIG. 28) may responsively activate the workstation position motor 84 such that the workstation position motor 84 of the workstation desk actuator 83 (FIG. 26) lowers or raises, as appropriate, the workstation desk 29 on the treadmill support structure 2, typically as was heretofore described.

In some applications, the user may elect to deploy the treadmill 40 from the stowage position to the functional position for use, either solely for exercise or for exercising while working at the workstation 28. Accordingly, the user may manipulate the treadmill position control 102 (FIG. 27) of the user interface 101. The main controller 108 may responsively cause the transmitter 115 to emit an activation signal which is received by the receiver 120 (FIG. 28). The receiver controller 121 (FIG. 28) may responsively activate the treadmill position motor 70 of the treadmill position actuator 56 such that the treadmill position motor 70 deploys the treadmill 40 along the treadmill traversal path 58 from the stowage position illustrated in FIGS. 18-22, through the intermediate position illustrated in FIGS. 13-17 to the functional position illustrated in FIGS. 1-5, typically as was heretofore described.

The user may initiate operation of the treadmill 40 by manipulation of the treadmill position control 103 (FIG. 27) of the user interface 101. The main controller 108 may responsively cause the transmitter 115 to emit an activation signal which is received by the receiver 120 (FIG. 28). The receiver controller 121 (FIG. 28) may responsively activate the treadmill motor 47 such that the treadmill motor 47 of the treadmill 40 causes the treadmill belt 50 (FIGS. 6 and 7) to traverse the treadmill platform 46 and the belt roller 48, typically as was heretofore described. The user may adjust the speed and direction typically by appropriate manipulation of the treadmill position control 103.

In the event that the user falls or steps off the treadmill 40, the main controller 108 (FIG. 27) may detect that the user is not present on the treadmill 40 via the motion detector 118. The main controller 108 may responsively terminate further operation of the treadmill motor 47 for safety purposes.

Figure 16:
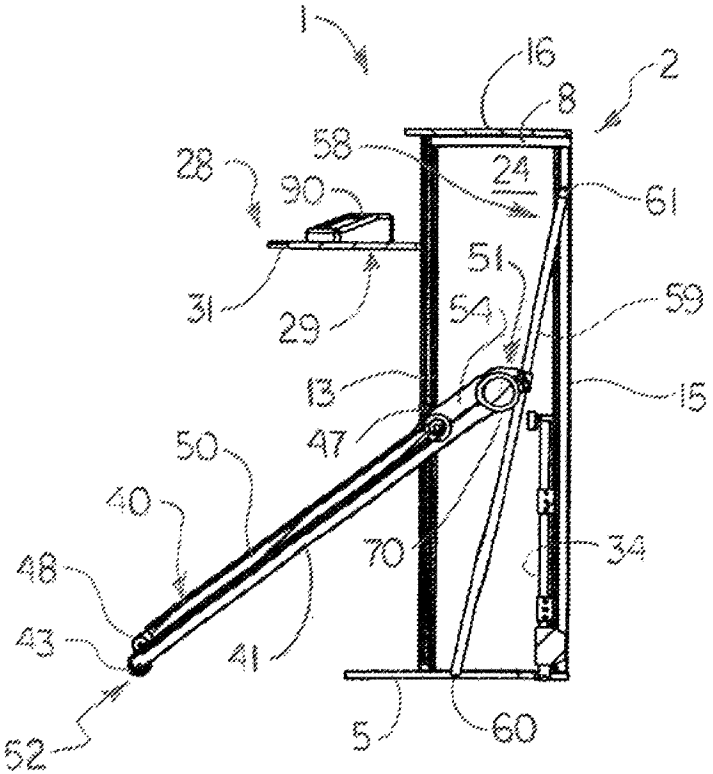
FIG. 16 is a sectional view, taken along section lines 16-16 in FIG. 13, of the illustrative system.
Figure 21:
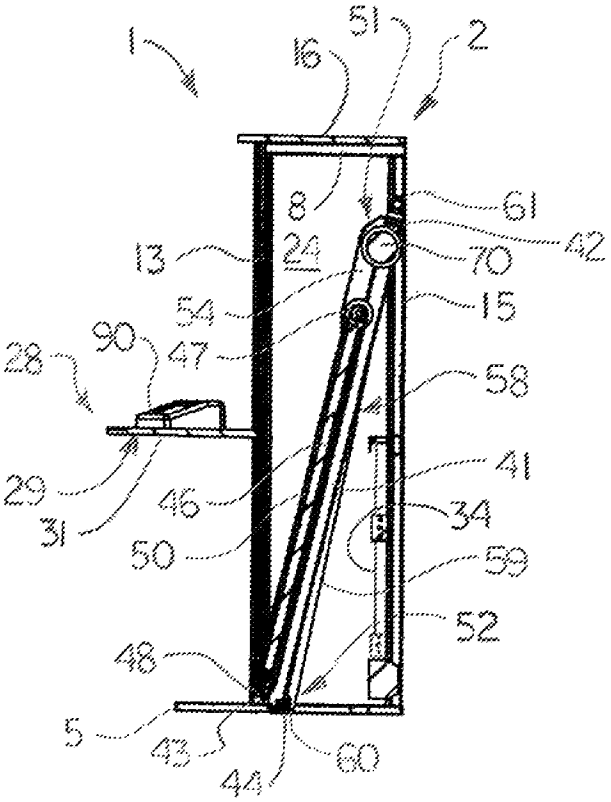
FIG. 21 is a sectional view, taken along section lines 21-21 in FIG. 18, of the illustrative system.

When use of the treadmill 40 is no longer desired, the treadmill 40 may be deployed from the functional position back to the stowage position in the support structure interior 24 of the treadmill support structure 2, typically by appropriate manipulation of the treadmill position control 102 (FIG. 27). Accordingly, the treadmill position motor 70 of the treadmill position actuator 56 may deploy the treadmill 40 in the forward direction from the functional position through the intermediate position to the stowage position along the treadmill traversal path 58, typically as illustrated in FIGS. 4, 16, and 21, and heretofore described.

While certain illustrative embodiments of the disclosure have been described above, it will be recognized and understood that various modifications can be made to the embodiments and the appended claims am intended to cover all such modifications which may fall within the spirit and scope of the disclosure.

What is claimed is:

1. A treadmill repositioning and storage system, comprising:

a workstation comprising:

a treadmill support structure having a support structure interior;

a treadmill opening in the treadmill support structure, the treadmill opening communicating with the support structure interior; and a workstation desk carried by the treadmill support structure above the treadmill opening, the workstation desk protruding forwardly from the support structure front, wherein the workstation desk comprises a pair of side desk portions protruding from the treadmill support structure and a front desk portion extending from the side desk portions and protruding from the support structure front;

a treadmill selectively deployable in a functional position wherein the treadmill extends from the support structure interior of the treadmill support structure through the treadmill opening and a stowage configuration wherein the treadmill is retracted into the treadmill support structure, the treadmill having a front treadmill end and a rear treadmill end; and a treadmill position actuator carried by the treadmill support structure in the support structure interior, the treadmill position actuator attached to the front treadmill end of the treadmill and configured to raise and lower the front treadmill end to deploy the treadmill between the functional position and the stowage position.

2. The system of claim 1 wherein the treadmill support structure has a treadmill support structure height, a treadmill support structure width, and a treadmill support structure depth, and the treadmill support structure height is greater than the treadmill support structure width and the treadmill support structure depth.

3. A treadmill repositioning and storage system, comprising:

a workstation comprising:

a treadmill support structure having a support structure interior;

a treadmill opening in the treadmill support structure, the treadmill opening communicating with the support structure interior; and a workstation desk carried by the treadmill support structure above the treadmill opening, the workstation desk protruding forwardly from the support structure front;

a treadmill selectively deployable in a functional position wherein the treadmill extends from the sup ort structure interior of the treadmill support structure through the treadmill opening and a stowage configuration wherein the treadmill is retracted into the treadmill support structure, the treadmill having a front treadmill end and a rear treadmill end;

a treadmill position actuator carried by the treadmill support structure in the support structure interior the treadmill position actuator attached to the front treadmill end of the treadmill and configured to raise and lower the front treadmill end to deploy the treadmill between the functional position and the stowage position; and a treadmill concealment panel carried by the support structure front of the treadmill support structure, the treadmill concealment panel deployable in lowered and raised positions to close and open, respectively, the treadmill opening as the treadmill deploys between the functional position and the stowage position.

4. A treadmill repositioning and storage system, comprising:

a workstation comprising:

a treadmill support structure having a support structure interior;

a treadmill opening in the treadmill support structure, the treadmill opening communicating with the support structure interior; and a workstation desk carried by the treadmill support structure above the treadmill opening, the workstation desk protruding forwardly from the support structure front;

a treadmill selectively deployable in a functional position wherein the treadmill extends from the support structure interior of the treadmill support structure through the treadmill opening and a stowage configuration wherein the treadmill is retracted into the treadmill support structure, the treadmill having a front treadmill end and a rear treadmill end;

a treadmill position actuator carried by the treadmill support structure in the support structure interior the treadmill position actuator attached to the front treadmill end of the treadmill and configured to raise and lower the front treadmill end to deploy the treadmill between the functional position and the stowage position; and wherein the treadmill position actuator comprises at least one treadmill traversal member; at least one frame collar carried by the treadmill and engaging the at least one treadmill traversal member, respectively, the at least one frame collar configured to traverse the at least one treadmill traversal member responsive to rotation of the at least one frame collar; and at least one treadmill position motor carried by the treadmill and drivingly engaging the at least one frame collar, respectively, for rotation.

5. The system of claim 4 wherein the at least one frame collar threadably engages the at least one treadmill traversal member, respectively.

6. The system of claim 4 wherein treadmill position actuator comprises a rack and pinion mechanism.

7. The system of claim 1 wherein the treadmill position actuator comprises at least one treadmill position motor carried by the treadmill, at least one treadmill pulley carried by the treadmill support structure in the support structure interior and at least one hoist cable having a first cable end engaged by the at least one treadmill position motor, respectively, the at least one hoist cable engaging the at least one treadmill pulley, respectively, and having a second cable end attached to the treadmill, the at least one hoist cable configured to deploy the treadmill between the functional position and the stowage position responsive to operation of the at least one treadmill position motor, respectively.

8. The system of claim 1 wherein the workstation desk is vertically adjustable on the treadmill support structure along the support structure front.

9. The system of claim 1 further comprising a control system having at least one user interface interfacing with the treadmill position actuator and at least one power source interfacing with the control system, the control system configured to facilitate operation of the treadmill position actuator by user manipulation of the at least one user interface.

10. The system of claim 9 further comprising at least one controller interfacing with the at least one user interface and at least one database interfacing with the at least one controller, respectively, the at least one database configured to store data related to sitting, standing, and walking statistics.

11. The system of claim 9 further comprising at least one electrical outlet on the treadmill support structure and electrically interfacing with the at least one power source.

12. A treadmill repositioning and storage system, comprising:

a workstation comprising:

a treadmill support structure having a support structure interior; and a workstation desk carried by the treadmill support structure;

a treadmill selectively deployable in a functional position wherein the treadmill extends from the support structure interior of the treadmill support structure and a stowage position wherein the treadmill is retracted into the support structure interior of the treadmill support structure, the treadmill disposed within a treadmill plane and having a front treadmill end and a rear treadmill end;

a sloped, planar treadmill traversal path defining movement of the front treadmill end of the treadmill between the functional position and the stowage position;

a treadmill position actuator carried by the treadmill support structure in the support structure interior, the treadmill position actuator attached to the front treadmill end of the treadmill and configured to deploy the treadmill between the functional position and the stowage position along the treadmill traversal path; and wherein the treadmill plane of the treadmill is disposed parallel to the treadmill traversal path in the stowage position of the treadmill.

13. The system of claim 12 wherein the treadmill traversal path has an initial treadmill position and a final treadmill position, and the front treadmill end of the treadmill coincides in position with the initial treadmill position in the functional position of the treadmill and with the final treadmill position in the stowage position of the treadmill.

14. The system of claim 13 wherein the rear treadmill end of the treadmill coincides in position with the initial treadmill position in the stowage position of the treadmill.

15. The system of claim 12 further comprising a treadmill opening in the treadmill support structure and communicating with the treadmill interior, the treadmill opening sized and configured to accommodate the treadmill as the treadmill deploys between the functional position and the stowage position, and wherein the workstation desk of the workstation is carried by the treadmill support structure above the treadmill opening.

16. The system of claim 12 wherein the workstation desk is vertically adjustable on the treadmill support structure.

17. The system of claim 16 wherein the workstation desk comprises a pair of side desk portions protruding from the treadmill support structure and a front desk portion extending from the side desk portions and protruding from the support structure front.

18. A treadmill repositioning and storage system, comprising:

a workstation comprising:

a treadmill support structure comprising:

a support structure front;

a support structure rear spaced-apart from the support structure front;

a pair of support structure sides extending between the support structure front and the support structure rear;

a support structure top on the support structure front, the support structure rear, and the pair of support structure sides;

a support structure interior formed by and between the support structure front, the support structure rear, the pair of support structure sides, and the support structure top; and a treadmill opening in the support structure front, the treadmill opening communicating with the support structure interior;

a vertically adjustable workstation desk carried by the treadmill support structure above the treadmill opening, the workstation desk comprising:

a pair of side desk portions protruding from the pair of support structure sides, respectively, of the treadmill support structure; and a front desk portion extending from the side desk portions and protruding forwardly from the support structure front of the treadmill support structure; and a workstation desk actuator operably engaging the workstation desk for vertical adjustment of the workstation desk on the treadmill support structure;

a treadmill selectively deployable in a functional position wherein the treadmill extends from the support structure interior of the treadmill support structure through the treadmill opening and a stowage position wherein the treadmill is retracted into the support structure interior of the treadmill support structure, the treadmill disposed within a treadmill plane and having a front treadmill end and a rear treadmill end;

a sloped, planar treadmill traversal path defining movement of the front end of the treadmill between the functional position and the stowage position;

a treadmill position actuator carried by the treadmill support structure in the support structure interior, the treadmill position actuator attached to the front treadmill end of the treadmill and configured to deploy the treadmill between the functional position and the stowage position along the treadmill traversal path, wherein the treadmill plane of the treadmill is disposed parallel to the treadmill traversal path in the stowage position;

a control system having at least one user interface controllably interfacing with the treadmill position actuator and the workstation desk actuator and at least one power source interfacing with the control system, the control system configured to facilitate operation of the treadmill position actuator and the workstation desk actuator by user manipulation of the at least one user interface; and a controller interfacing with the user interface and at least one database interfacing with the controller, the at least one database configured to store data related to sitting, standing, and walking statistics.

19. The system of claim 18 wherein the treadmill traversal path has an initial treadmill position and a final treadmill position, and the front treadmill end of the treadmill coincides in position with the initial treadmill position in the functional position of the treadmill and with the final treadmill position in the stowage position of the treadmill, and wherein the rear treadmill end of the treadmill coincides in position with the initial treadmill position in the stowage position of the treadmill.

* * * * *